United States Patent [19]

Hnatuk

[11] Patent Number: 4,903,877

[45] Date of Patent: Feb. 27, 1990

[54] TABLET BREAKING APPARATUS

[75] Inventor: William Hnatuk, Maple Glen, Pa.

[73] Assignee: Merck & Co, Inc., Rahway, N.J.

[21] Appl. No.: 187,942

[22] Filed: Apr. 29, 1988

[51] Int. Cl.[4] ..... A61J 3/00; B26F 3/00

[52] U.S. Cl. ..... 225/93; 225/96.5

[58] Field of Search ..... 225/93, 96.5, 103; 206/528; 30/124; 241/DIG. 27

[56] References Cited

U.S. PATENT DOCUMENTS

| | | | |
|---|---|---|---|
| D. 196,457 | 10/1963 | Wagner . | |
| 2,655,259 | 10/1953 | Davoren | 225/93 |
| 3,517,871 | 6/1970 | Gaffney et al. | 225/103 |
| 3,650,445 | 3/1972 | Heitzman | 225/93 |
| 3,815,802 | 6/1974 | Stevens | 225/93 |
| 4,173,826 | 11/1979 | Leopoldi et al. | 225/103 |
| 4,225,072 | 9/1980 | Reeves | 225/104 |
| 4,330,936 | 5/1982 | Swarth | 225/103 |
| 4,409,843 | 10/1983 | Urban et al. | 225/103 |
| 4,422,553 | 12/1983 | Hoeks et al. | 206/528 |
| 4,473,192 | 9/1984 | Urban et al. | 225/93 |
| 4,697,344 | 10/1987 | Leopoldi | 225/103 |

FOREIGN PATENT DOCUMENTS

| | | | |
|---|---|---|---|
| 2086715 | 12/1971 | France | 225/93 |

*Primary Examiner*—Hien H. Phan

*Attorney, Agent, or Firm*—Lower, Price, LeBlanc, Becker & Shur

[57] ABSTRACT

A conventional closure or cap for a tablet-container is formed to have a recess of predetermined depth and shape to loosely receive therein a tablet preferably provided on at least one side with a stress-raising notch or score mark, so that the application of a lateral force on an upper portion of the tablet by a finger or thumb of the user will cause the tablet to break approximately along a plane extending across the tablet from the bottom of the stress-raising notch. In another aspect of the invention, the tablet preferably provided on at least one side with a stress-raising notch or score mark is laid with the notch downward into a recess provided with a partial movable base so that the application of force on the exposed surface of the tablet by a finger or thumb of the user causes the tablet to be supported close to its ends to thereby experience a break at the notch.

13 Claims, 3 Drawing Sheets

TABLET BREAKING APPARATUS

FIELD OF THE INVENTION

This invention relates to apparatus for breaking a tablet such as a medicinal tablet into smaller parts thereof and, more particularly, to apparatus suitable for integration into a cap or other closure means for a tablet container for convenient breakage of tablets obtained therefrom by a user.

BACKGROUND OF THE PRIOR ART

Medicinal tablets are produced in a variety of shapes, sizes and varying degrees of hardness, depending on the constituents included. Since the needs of individual patients may vary and it is expensive to produce and market a particular medicine in a variety of sizes to facilitate convenient prescription thereof to suit individual needs, it is common practice to produce relatively large tablets that may be broken into fractions thereof to suit a user's specific needs. Thus, a production facility may produce relatively large and hard tablets, avoiding waste due to breakage of the tablets during manufacture and the need for complex machinery to produce more numerous smaller tablets. By breaking such relatively large tablets into smaller parts a patient can conveniently and closely follow the medical regimen prescribed by his doctor.

Many medicinal tablets generally have an elongate, oblong or elliptical shape, with the center usually thicker than the outside. Some individuals have problems swallowing such tablets even when the amount of medication contained in each tablet is precisely what they should take. For such persons too, as will be appreciated, the facility to break a tablet into smaller pieces is helpful. For this reason, most large medicinal tablets are produced with generally central weakened cross-sections, preferably by forming them with a central stress-raising notch having sloping sides.

There are, in fact, a number of devices intended to accomplish the particular purpose to which the present invention relates.

U.S. Pat. No. 3,815,802, to Stevens, provides a raised ridge built into the cap of a tablet container, or provided as part of an insert locatable therewithin, so that the user must carefully locate the tablet with the score mark uppermost on the ridge and then press on both sides of the tablet hard enough to break the tablet. In an alternative embodiment, a concave arcuate apex-type structure is formed on either the cap or the insert locatable therewithin and, here again, the user must carefully position the tablet thereover and press hard at the center to break the tablet.

U.S. Pat. No. 4,473,192, to Urban et al, teaches a tablet breaking device in which a tablet is held in a notch having a generally tapered cross-section (to accommodate tablets of varying sizes) and must be carefully positioned so that one of its transverse surfaces presses along an edge, whereafter a hinged lid is forcibly pressed on the topmost portion of the tablet to break the same, with the topmost broken-off piece falling into a recess to receive the same. In a variation on this theme, U.S. Pat. No. 4,409,843, also to Urban et al, discloses a somewhat similar structure in which a tablet is laid over a sharp edge with one side held down by the structure integral with the sharp edge, with a mechanical force applied to the topmost edge of the tablet to break the same over the sharp edge.

Design U.S. Pat. No. 196,457 to Wagner discloses, obviously without any discussion of its utilitarian aspects, a container closure that has a pyramidal central portion having two sloping sides, with one of the sides provided with a relatively shallow elongate recess for purposes unknown.

Various other devices are known in which a sharp edge or two sharp edges are forced against a pill to exercise a cutting action thereon, such examples including U.S. Pat. No. 2,655,259 to Davoren, U.S. Pat. No. 4,330,936 to Swarth and U.S. Pat. No. 4,422,553 to Hoeks et al.

Tablet or pill cutting devices that utilize sharp edges contacting the tablet and elastic elements partially resisting an externally applied force to produce breakage over the sharp edge include, for example, U.S. Pat. Nos. 4,173,826 to Leopoldi et al, 3,517,871 to Gaffney et al and 4,225,072 to Reeves.

Other known devices referred to hereinabove involve relatively complex structure, sharp edges, and inconvenient operation in use. Many patients who frequently have to break tablets to take them include elderly persons with shaky hands and not much strength. For such persons in particular, most of the known devices are not convenient to use.

A need, therefore, exists for simple, inexpensive and easy to use apparatus that will enable even a relatively infirm user of tablets to break individual tablets by the application of a simple direct force applied by his or her finger to the side of a tablet to break the same, preferably at a score mark if one is provided on the tablet. The present invention provides different embodiments that are regarded as particularly suitable for incorporation with standardized tablet bottle caps or lids at an almost negligible additional expense.

SUMMARY OF THE DISCLOSURE

It is a principal object of this invention to provide a simple and inexpensive apparatus with which a user can easily break a tablet into parts of predetermined size.

It is a related object of this invention to provide, as an integral part of a cap or closure means for a tablet container or bottle, apparatus that will enable a user of the tablets to readily break them individually into portions of predetermined size.

It is a further object of the present invention to provide apparatus by which a user of tablets may readily break the same into two equal parts, with the apparatus being permanently connectable to any of a series of standardized caps for containers or bottles of such tablets.

These and other objects of this invention are realized in a first embodiment by providing apparatus that has a body with a recess formed to have a base and a side wall that is sized and shaped to receive loosely therein a predetermined portion of an inserted tablet, and a fulcrum point on the body located with respect to the side wall of the recess to contact a first surface of the tablet, such that when the user forcibly pushes the tablet against the fulcrum point reaction forces are generated at the fulcrum point and in the recess which coact together with the user-applied force to break the tablet at the fulcrum point. This apparatus can be formed either as an integral part of the closure means or bottle cap or as a separate element connectable to such a cap.

In another aspect of the invention, a projection is provided extending normal to the base of the above-described recess so as to contact a tablet inserted into the recess to limit insertion of the tablet to only half its length into the recess. In yet another aspect of the present invention, a portion of the side wall of the recess is constricted such that the location of the constriction helps properly locate a tapered tablet and also determines the location of a reaction force between the side of the recess and a contacting portion of the tablet, the reaction force coacting with the force between the tablet and the fulcrum point and the user-applied force to cause breakage of the tablet at the fulcrum point.

In another embodiment of the present invention, a body is provided a recess having a first wall shaped to loosely receive the largest cross-section of the tablet laid therein, the recess having a flat partial fixed base provided by surfaces extending inwardly from opposite sides of the recess wall to define two edge portions of a through aperture in the body. The flat bottom of the recess also prevents the nose of a tablet, entering the through aperture area and facilitates positioning of the tablet horizontally. A movable adjustable base is provided in the recess between the fixed partial base surfaces thereof, the adjustable base portion normally being coplanar with the partial fixed base surfaces but being able to restorably recede into the through aperture in response to a user-applied force communicated to the adjustable base portion through the tablet laid inside the first recess. Upon the application of such a force by the user, for example, by pressing with his finger on the center of the tablet laid in the recess, the tablet and the adjustable base will both move downward into the recess until the fixed base portions of the recess generate reaction forces on both sides of the tablet and these reaction forces coact with the user-applied force to fracture the tablet substantially at the center. Like the other embodiments discussed hereinabove, this embodiment also can be formed as an integral portion of the closure means for a container of tablets or as an element connectable to such a closure means.

Persons skilled in the art will no doubt consider variations of the embodiments disclosed and claimed herein within the spirit of this invention. The preferred embodiments are best understood with reference to FIGS. 1–9 and the detailed description that follows.

DESCRIPTION OF THE PREFERRED EMBODIMENTS

Medicinal tablets most commonly are sold in small glass or plastic bottles provided with a detachable cap which, in a relatively simple form, has a threaded inner portion that engages an externally threaded portion of the bottle. Such caps, upon occasion, may also be designed to be child-proof or tamper-proof.

Figure 2:
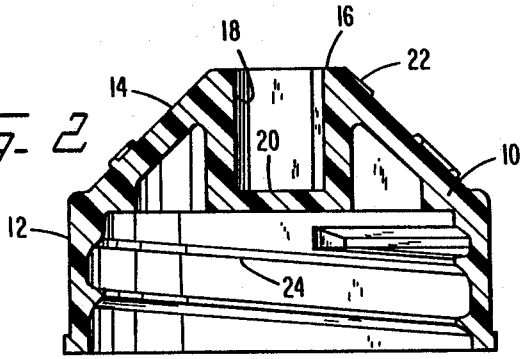
FIG. 2 is a vertical cross-sectional view at section A—A of the embodiment illustrated in FIG. 1.
Figure 3:
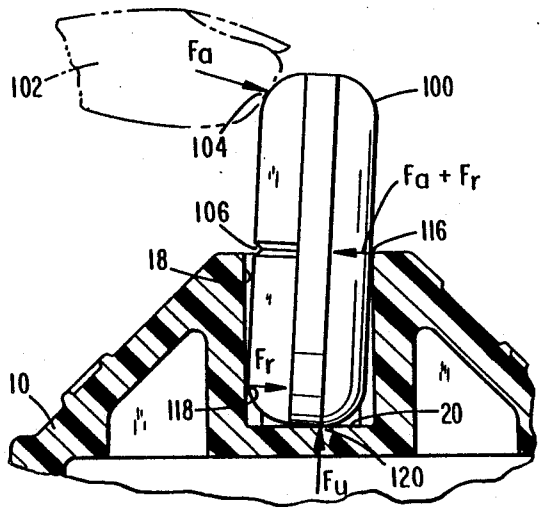
FIG. 3 is an enlarged view of the principal portion of the invention according to FIG. 1 to illustrate the distribution of forces involved in breaking a tablet therewith.
Figure 1:
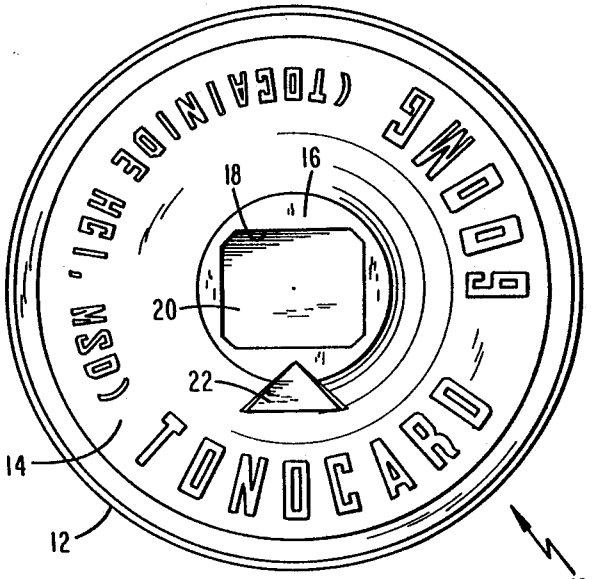
FIG. 1 is a plan view of a first preferred embodiment of this invention in the form of a cap for a tablet container or bottle.

In any such variation, the tablet-breaking apparatus of the present invention can be provided as an integral part of such a typical molded plastics cap 10, as best understood with reference to FIGS. 1, 2 and 3. In this first preferred embodiment, a bottle cap 10 has a generally cylindrical lower outer surface 12 that may be provided with small ridges or a knurled surface of known type to facilitate easy grasping thereof for removal from the tablet bottle. In this exemplary embodiment, bottle cap 10 has an upper generally conical portion 14 terminating in the uppermost annular surface 16 surrounding a recess having a defining wall 18 of predetermined shape and a generally flat base 20. The shape selected to be defined by side wall 18 may be chosen to suit the particular tablets contained in the bottle and to be individually broken after placement in the recess as fully described hereinbelow. An arrow-like shape 22 may be molded on the conical surface 14 to advise a user where a tablet should be placed to be broken, i.e., pointing to the tablet-receiving recess as described and indicating the direction in which the user should apply a force on the tablet. An internal thread 24 may be provided in the generally cylindrical portion 12 of the cap to match similar threads on the outside of the tablet bottle (not shown).

FIG. 2 is a vertical cross-section at section A—A of the cap illustrated in plan view in FIG. 1. It will be seen that side wall 18 and base 20 together define a generally cubical recess with rounded corners. Other shapes may be selected as desired. Such a shape is readily molded into the plastic structure of the cap and adds very little to the overall manufacturing costs, both in terms of forming the cap and in terms of the additional material required.

As best understood with reference to FIG. 3, which is merely an enlarged view of the principal portion of cap 10, a typical tablet 100 is placed in the recess of cap 10 so that a bottom corner of tablet 100 contacts base 20 of the recess at a point 120. A user may then apply a finger or thumb 102 at a point 104 on a surface of the tablet that is provided with a stress-raising notch or score mark 106 having a generally V-shaped cross-section. The recess is formed of a shape and size adequate to loosely receive the tablet therein, so that the application of user-applied force $F_a$ causes a tablet surface on the other side of notch 106 to contact an edge defined by surface 16 and recess surface 18 at a point 116.

As will be appreciated by persons skilled in the mechanical arts, tablet 100 under these circumstances will experience the following forces: applied force $F_a$ directed by a user's finger or thumb at point 104 (most likely directed generally sideways and slightly downward as indicated), an upward reaction force $F_u$ by the base 20 on the bottommost corner of tablet 100, a reaction force $F_r$ at point 118 where the scored side of the tablet contacts wall 18 close to base 20, and a reaction force $F_a + F_r$ at point 116.

As will be appreciated, although the tablet itself may be relatively hard, the material of the tablet typically is not capable of sustaining a large tensile force. Upon being subjected to the hitherto described set of applied and reaction forces, material at the bottom of notch 106 typically will be in tension, and a crack will initiate thereat and travel across the thickness of tablet 100. The tablet 100 will thus crack approximately along the plane between the base of notch 106 and point 116. The actual force $F_a$ required of the user under these circumstances is low enough to be readily provided even by a sick, elderly, or otherwise infirm individual. In this manner, a user may extract a tablet, close he bottle with cap 10, place tablet 100 in the recess as best understood with reference to FIG. 3, and merely push on the upper extending portion of tablet 100 to cause the same to break along the base of notch 106.

The presence of notch 106, while it facilitates breakage of the tablet at a predetermined weakened cross-section thereof, is not essential. In other words, while the presence of notch 106 makes it easier to break the tablet into two practically equal halves, even an unnotched tablet may be readily broken approximately at a plane passing through point 116 across the thickness of tablet 100 in the manner described hereinabove. Actually, if a tablet 100 is formed to have two opposing notches like notch 106, one on each side, the user need not necessarily position the tablet with a particular side facing his finger 102 as indicated in FIG. 3. Such a tablet would crack readily no matter how it was placed in the recess.

Figure 5:
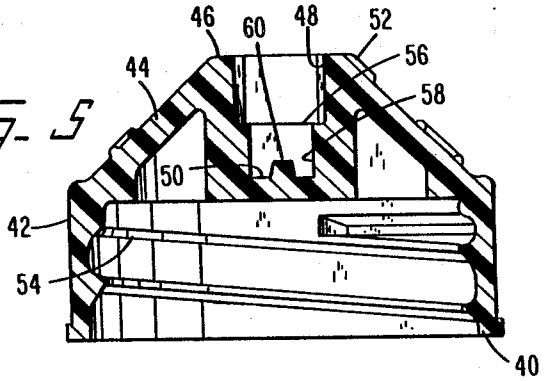
FIG. 5 is a vertical cross-sectional view at section B—B of the embodiment illustrated in FIG. 4.
Figure 6:
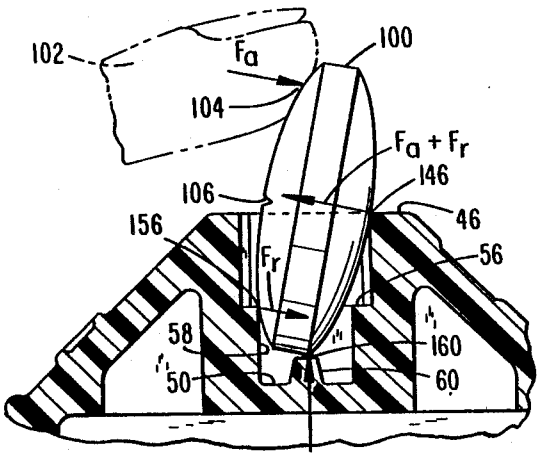
FIG. 6 is an enlarged view of the principal portion of the invention according to FIG. 5 to illustrate the distribution of forces involved in breaking a tablet therewith.
Figure 4:
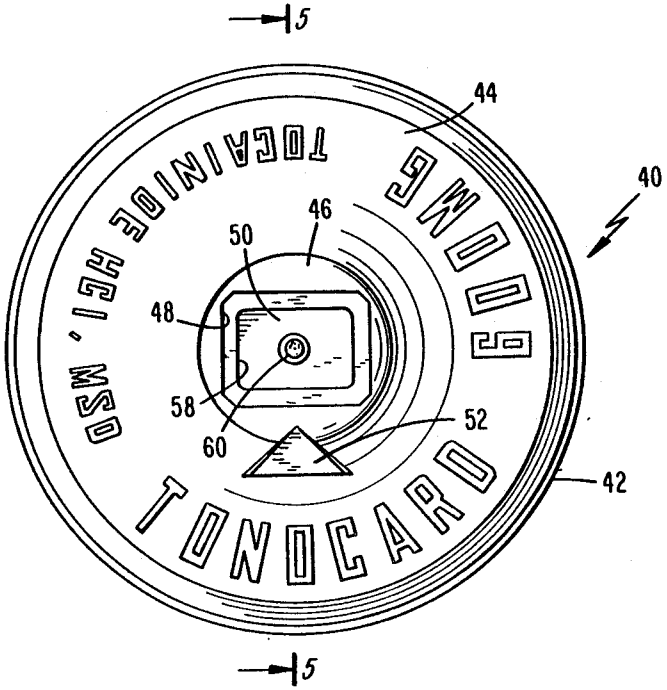
FIG. 4 is a plan view of a second preferred embodiment of this invention in the form of a closure or cap for a tablet container or bottle.

It is possible that the material of which the tablet is made has a tendency to crumble somewhat when subjected to a breaking force. A variation of the preferred embodiment described hitherto, as illustrated in FIGS. 4–6, helps facilitate breakage of such tablets. As best seen with reference to these figures, a bottle cap 40, having a generally cylindrical exterior surface portion 42 provided with ridges or a knurled surface for ease of closure of the bottle, has a generally conical portion 44 terminating in an upper annular surface 46. Preferably within the central portion of cap 40 is provided a recess having an upper defining wall portion 48 and a lower, more constricted, defining wall portion 58 ending in a base 60. The wall portions 48 and 58 meet at an annular surface forming an edge 56 with defining surface 58. In the embodiment illustrated in FIGS. 4–6, a small generally upright projection 60 is formed at the center of base 50 for convenience in molding the cap and so that when a tablet 100 is placed within the recess, the lowermost point will contact the topmost surface of projection 60 with half the tablet inside the recess, as best understood with reference to FIG. 6.

As before, the conical surface 44 of cap 40 may be formed to have an arrow-type structure 52 molded in to guide the user and an internal thread 54 may be provided to facilitate screwing-on of cap 40 onto a matchingly externally threaded bottle.

As best understood with reference to FIG. 6, upon placement of a tablet 100 with its lowermost point contacting the top of projection 60 (or the bottom of the recess if no projection 60 is formed), the user may apply a finger or thumb 102 to exert a force $F_a$ at a point 104 on a side of tablet 100 that is provided with a stress raising notch or score mark 106. The application of the user-applied force $F_a$ will force the lower portion of the notched surface of tablet 100 to contact the constricted surface 58 of the recess at a point 156 defined by the intersection of annular surface 56 and stress-defining surface 58 at a point 156. At the same time, the surface of tablet 100 on the opposite side from notch 106 will contact an edge defined by the intersection of annular surface 46 and the recess-defining surface 48 at point 146.

Under these circumstances, tablet 100 will be subjected to the following forces: $F_a$ provided by direct application of a user's finger or thumb at point 104, a generally upward reaction force $F_u$ at point 160 at the top of projection 60, a sideways reaction force $F_r$ at point 156 on the notched side of tablet 100, and a reaction force $F_a+F_r$ at point 146 directed generally oppositely of the user-applied force $F_a$. Under the combined action of these forces, tablet 100 will experience tensile stress generally at or near the bottom of notch 106 and will break approximately along the plane containing the base of notch 106 and point 146. Therefore, if notch 106 is provided at the midpoint of tablet 100, the tablet will break into two practically equal pieces.

As with the first preferred embodiment per FIGS. 1–3, the structure described hereinabove for the second preferred embodiment per FIGS. 4–6 is extremely easy to form when molding the typical bottle cap 40 of plastics material. As indicated in FIG. 6, all corners of the recess may be rounded and such a cap can be readily and inexpensively molded in conventional manner.

The two embodiments described hitherto both function in very similar ways, and although each provides a slightly different function, both require the user to apply only a simple, generally sideways force by means of a finger or thumb after placement of a tablet within the recess.

Figure 9:
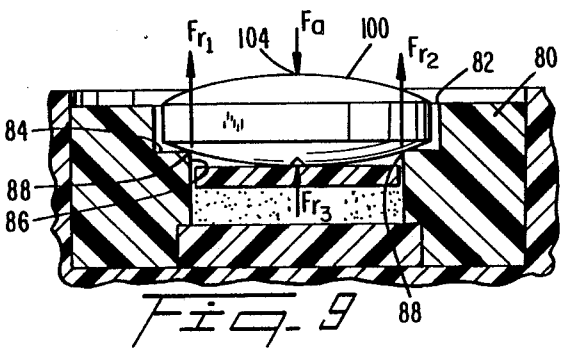
FIG. 9 is another view of the embodiment as illustrated in FIG. 8A, to more clearly illustrate the forces required to break a tablet therewith.

In yet another embodiment according to the present invention, as best understood with reference to FIGS. 9–10 hereof, a tablet-breaking element 80 can conveniently be formed of a plastics material by conventional molding processes. Element 80 has a generally cylindrical outward shape and is provided at one end with a relatively shallow recess shaped and sized to loosely accommodate a tablet laid therein for breakage as described hereinbelow. The recess is defined by a wall surface 82 and an overall base surface 84, the recess preferably being somewhat smaller than the thickness of the tablet to be used therewith.

A typical tablet 100 has an elongate, oblong or elliptic shape and, generally, so will recess-defining but slightly larger wall surface 82.

Essentially coaxially with the typically symmetrical defining surface 82 of the recess is provided a through aperture, preferably defined by cylindrical through aperture 86 which intersects with base surface 84 of the recess at two arcuate edges 88. There is thus defined a partial fixed base to the recess, by inwardly extending portions of the base surface 84 terminating at edges 88.

Within the through aperture defined by wall 86 is provided a movable partial base element 90, preferably having the form of a flat circular disk slightly smaller than the through aperture defined by cylindrical wall 86 so as to be received therein. Note that because cylindrical wall 86 is circular and has a diameter greater than the smaller dimension of the recess defined by wall 82 thereabove, movable partial base element 90 cannot move into the upper recess past base 84. Other shapes for the cross-section of the through aperture should also work equally well if sized appropriately. Movable base element 90, on the side away from fixed base surface 84, is contacted by a generally similarly shaped element 92 which is capable of deforming resiliently to exert a restoring or resisting force to any motion of partial base element 90 when subjected to an external force tending to drive it within the through aperture. Movable base element 90 also prevents the nose of a tablet from entering the through aperture area and thus facilitates alignment of the tablet in recess 82. The resilient element 92 is retained in place by a support element 98 firmly attached in a recess 96 provided at the far end of through aperture in element 80. This support element 98 may be force-fitted, glued in, or otherwise firmly attached in place.

Figure 8A:
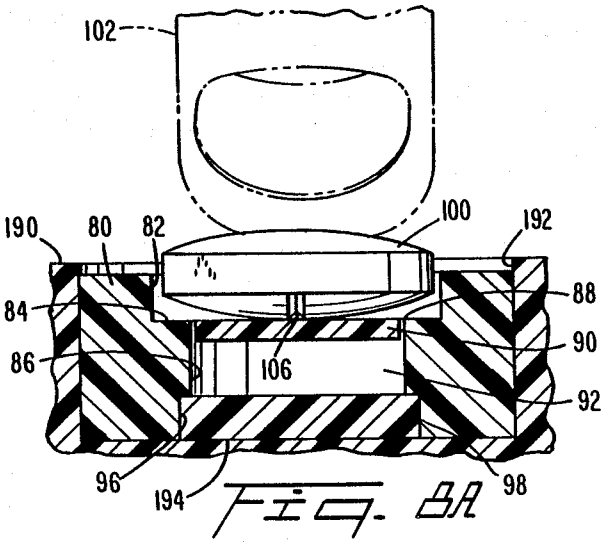
FIG. 8A is a vertical cross-sectional view at section C—C of the embodiment illustrated in FIG. 7.
Figure 8B:
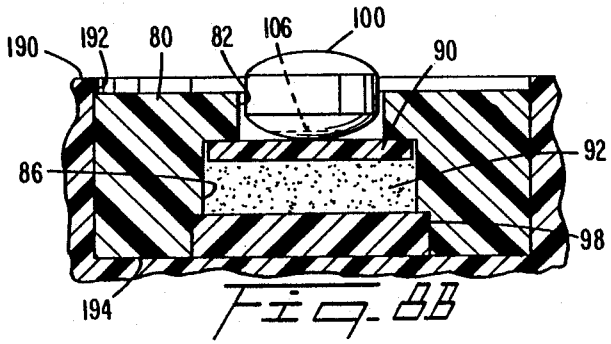
FIG. 8B is a vertical cross-sectional view at section D—D of the embodiment illustrated in FIG. 7.
Figure 7:
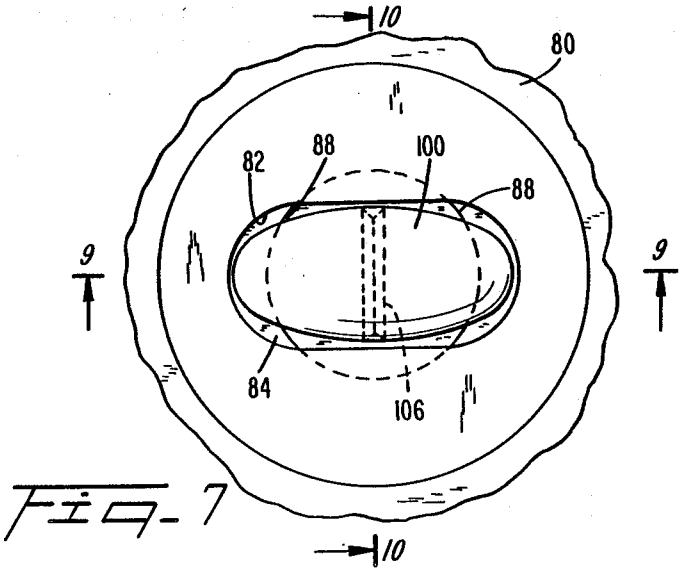
FIG. 7 is a plan view of a third preferred embodiment of this invention in the form of a body connectable to a closure means or a cap for a tablet

Referring now to FIGS. 8A and 8B, it will be understood how a tablet 100 can be laid with the face provided with a stress-raising notch or score mark 106 downward to contact an upper surface of movable partial base element 90. Until the user applies a force onto the tablet to overcome the resilient resistance of resilient element 92, the tablet contacts only the partial movable base element 90, as best understood with reference to FIGS. 8A and 8B. When the user, by pressing downwardly with his finger or thumb 102, forces tablet 100 into the recess, partial movable base element 90 will be forced to slide into the through aperture in overcoming the resilient resistance force provided by resilient element 92 held in place by support element 98.

Upon the application of a sufficiently large force $F_a$ by the user, preferably at a central point of tablet 100 on the side away from notch 106, as best understood with reference to FIG. 9, tablet 100 will make contact along edges 88 close to both of its ends and will experience reaction forces $F_{r1}$ and $F_{r2}$ as well as a relatively small upwardly directed reaction force $F_{r3}$, all the reaction forces being directed generally opposite to the direction of applied force $F_a$. Upon the application of a sufficiently large force $F_a$, which should be well within the capacity of ill, elderly or otherwise infirm users, coaction of the applied and reaction forces will cause tablet 100 to experience tensile forces at or near the base of notch 106 and willcrack thereat. If notch 106 is provided at the midpoint of elongate tablet 100, breakage of tablet 100 will result in two practically equal halves of the tablet.

It will be appreciated that element 80 may be readily formed by conventional molding techniques and that partial movable base element 90, resilient element 92 and support element 98 all, likewise, will be easily and inexpensively manufactured and assembled to desired dimensions. It should also be appreciated that resilient element 92 may conveniently be formed of sponge rubber material, a helical spring, or anything that will provide an elastic resilient resisting force. It will also be appreciated that support element 98 may be firmly attached in place to element 80 in any conventional manner.

Persons skilled in the manufacturing arts will appreciate that element 80 may be readily and inexpensively manufactured to suit each of a variety of tablet sizes and shapes as desired. From the point of view of maintaining an inventory of bottles provided with the apparatus according to this particular embodiment of the present invention, it is highly advantageous to provide tablet bottles with standardized closure caps 190, each having a recess defined by a wall 192 and a flat base 194, as best seen with reference to FIGS. 8A and 8B. Such a cap may have a standard portion of conventional type to attach to a tablet container, may be child-proof or tamper-proof as desired, and may be made of a known, preferably plastics material. Given such a cap with a generally cylindrical recess defined by wall 192 and base 194, any one of a variety of elements 80, each distinguished by having a recess-defining surface 82 selected to suit a particular tablet, may be force-fitted into cap 190 or, if more convenient, glued in place by providing a small amount of adhesive to base 194. In this manner, the benefits of this particular embodiment may be realized for a variety of tablet shapes and sizes with any of a large number of standardized caps.

There have been described hitherto three specific embodiments of the present invention and, undoubtedly, persons skilled in the art will consider obvious modifications to the teaching hereof. Naturally, given the simplicity of design and the relatively low expense of utilizing the present invention in conventional bottle caps, such variations of the present invention may be expected and are intended to be comprehended in the invention defined by the claims entered below.

What is claimed is:

1. Apparatus for breaking a tablet into parts comprising:

a body having a recess, formed to have a base, a side wall that is sized and shaped to loosely receive a predetermined portion of said tablet inserted therein and a projection extending normal to said base of said recess so as to contact the tablet inserted into said recess when one half of the tablet is entered into the recess; and a fulcrum point on said body, located with respect to said side wall so as to contact a surface of the tablet when the tablet is forcibly pushed against said fulcrum point by a user-applied force, the application of said user-applied force generating a first reaction force by contact between the fulcrum and said tablet and a second reaction force by contact between said side wall and a portion of the tablet received within the recess, the coaction of said user-applied force and said first and second reaction forces producing breakage of the table substantially at said fulcrum, wherein a portion of said side wall of said recess is constricted, whereby the location of said constriction determines the location of said second reaction force between said side wall and said tablet.

2. Apparatus according to claim 1, wherein:

said body is a closure element of a container means for containing said tablet.

3. Apparatus according to claim 1, wherein:

said apparatus is outwardly shaped and sized to permanently connect to a standardized closure element of a means for containing at least one said tablet.

4. Apparatus according to claim 1, wherein:

said fulcrum point is so located that when said predetermined portion of the tablet is inserted into said recess the fulcrum point contacts said tablet substantially at a weakened section thereof.

5. Apparatus for breaking a tablet into parts, comprising:

a body having a recess, formed to have a base and a side wall, that is sized and shaped to loosely receive a predetermined portion of said tablet inserted therein; and a fulcrum point on said body, located with respect to said side wall so as to contact a surface of the tablet when the tablet is forcibly pushed against said fulcrum point by a user-applied force, the application of said user-applied force generating a first reaction force by contact between the fulcrum and said tablet and a second reaction force by contact between said side wall and a portion of the tablet received within the recess, the coaction of said user-applied force and said first and second reaction forces producing breakage of the tablet substantially at said fulcrum, wherein a portion of said side wall of said recess is constricted, whereby the location of said constriction determined the location of said second reaction force between said side wall and said tablet.

6. Apparatus according to claim 5, wherein:

said body is a closure element of a container means for containing said tablet.

7. Apparatus according to claim 6, wherein:

said fulcrum point is so located that when said predetermined portion of the tablet is inserted into said recess the fulcrum point contacts said tablet substantially at a weakened section thereof.

8. Apparatus according to claim 5, wherein:

said apparatus is outwardly shaped and sized to permanently connect to a standardized closure element of a means for containing at least one said tablet.

9. Apparatus according to claim 8, wherein:

said fulcrum point is so located that when said predetermined portion of the tablet is inserted into said recess the fulcrum point contacts said tablet substantially at a weakened section thereof.

10. Apparatus for breaking a tablet into parts at a weakened cross-section thereof, comprising:

a body having a recess, formed to have a base and a side wall, sized and shaped to loosely receive a predetermined portion of said tablet inserted therein; and fulcrum point on said body, located with respect to said side wall so as to contact a first surface of the table substantially at the weakened cross-section thereof when the tablet is forcibly pushed against said fulcrum point by a user-applied force, the application of said user-applied force generating a first reaction force by contact between the fulcrum and said tablet and a second reaction force by contact between said side wall and a portion of the tablet received within the recess, the coaction of said user-applied force and said first and second reaction forces producing breakage of the table substantially at said weakened section of the tablet, wherein a portion of said side wall of said recess is constricted, whereby the location of said constriction determines the location of said second reaction force between said side wall and said tablet.

11. Apparatus for containing a plurality of tablets and providing a facility for breaking individual tablets into parts, comprising:

a closable container means for containing said plurality of tablets;

a body formed to connect with said container means to close the same, having a recess formed to have a base and a side wall that is sized and shaped to loosely receive a predetermined portion of a tablet inserted therein; and a fulcrum point on said body, located with respect to said side wall, so as to contact a surface of the table when the tablet is forcibly pushed against said fulcrum point by a user-applied force, the application of said user-applied force generating a first reaction force by contact between the fulcrum and said tablet and a second reaction force by contact between said side wall and a portion of the table received within the recess, the coaction of said user-applied force and said first and second reaction forces producing breakage of the tablet substantially at said fulcrum, wherein a portion of said side wall of said recess is constricted, whereby the location of said constriction determines the location of said second reaction force between said side wall and said tablet.

12. Apparatus for containing a plurality of tablets and providing a facility for breaking individual tablets into parts at weakened cross-sections thereof, comprising:

a closable container means for containing said plurality of tablets;

a body formed to connect with said container means to close the same, having a recess formed to have a base and a side wall sized and shaped to loosely receive a predetermined portion of a tablet inserted therein; and a fulcrum point on said body, located with respect to said side wall so as to contact a first surface of the table substantially at the weakened cross-section thereof when the tablet is forcibly pushed against said fulcrum point by a user-applied force, the application of said user-applied force generating a first reaction force by contact between the fulcrum and said tablet and a second reaction force by contact between said side wall and a portion of the tablet received within the recess, the coaction of said user-applied force and said first and second reaction forces producing breakage of the tablet substantially at said weakened cross-section of the tablet, wherein a portion of said side wall of said recess is constricted, whereby the location of said constriction determines the location of said second reaction force between said side wall and said tablet.

13. Apparatus for containing a plurality of tablets and providing a facility for breaking individual tablets into parts, comprising:

a closable container means for containing said plurality of tablets;

a body formed to connect with said container means to close the same, having a recess defined in part by a first wall shaped to loosely receive the largest cross-section of a tablet laid therein, said recess having two fixed partial base surfaces extending inwardly from opposite sides of said first wall to partially define two edge portions of a through aperture in said body; and adjustable base means for providing an adjustable partial base to the recess, said adjustable partial base normally being coplanar with said fixed partial base surfaces of said recess but being able to restorably recede into said through aperture in response to a user-applied force communicated through said tablet laid inside said recess, whereby said recession of said adjustable base causes said tablet to experience reaction forces caused by forcible contact between the tablet and the fixed partial base surfaces at said two edge portions defined thereby, the coaction of the user-applied force and the reaction forces producing breakage of the tablet at said weakened cross-section.

* * * * *